US005294195A

United States Patent [19]

Amr et al.

[11] Patent Number: 5,294,195

[45] Date of Patent: Mar. 15, 1994

[54] COVER FOR THE OUTSIDE ENCLOSURE OF AN AIR CONDITIONING SYSTEM

[75] Inventors: Yehia M. Amr, Manlius, N.Y.; W. Joseph Fallows, III, Windsor, Mass.

[73] Assignee: Carrier Corporation, Syracuse, N.Y.

[21] Appl. No.: 970,445

[22] Filed: Nov. 2, 1992

[51] Int. Cl.[5] ..... F24F 13/20

[52] U.S. Cl. ..... 312/236; 312/223.1; 165/122

[58] Field of Search ..... 312/100, 223.1, 236; 165/122, 125

[56] References Cited

U.S. PATENT DOCUMENTS

| | | | |
|---|---|---|---|
| 2,159,913 | 5/1939 | Tenney | 165/125 |
| 2,798,694 | 7/1957 | Sullivan | 165/122 X |
| 3,874,191 | 4/1975 | Hudson | 165/122 X |
| 4,020,310 | 4/1977 | Souder, Jr. et al. | 312/236 X |
| 4,153,310 | 5/1979 | Loving et al. | 312/236 X |
| 4,951,182 | 8/1990 | Simonson et al. | 312/100 |

*Primary Examiner*—Peter R. Brown

[57] ABSTRACT

A cover intended for use in conjunction with the outside enclosure, usually containing the outside heat exchanger and compressor, of an air conditioning system. The cover features a recessed rainproof compartment in which may be located electrical and other components of the system, eliminating the need for and expense of an unsightly or inaccessible equipment box to house those components. The compartmented cover is intended for fabrication from plastic materials by a molding process to minimize cost and weight, maximize strength and durability and to present an aesthetically pleasing appearance.

2 Claims, 3 Drawing Sheets

COVER FOR THE OUTSIDE ENCLOSURE OF AN AIR CONDITIONING SYSTEM

BACKGROUND OF THE INVENTION

This invention relates generally to air conditioning systems. More particularly, the invention relates to a cover for the enclosure that houses the outside heat exchanger of what is known as a "split" vapor compression air conditioning or heat pump system.

In a split air conditioning system, one of the air-to-refrigerant heat exchangers of the system is located outside the space (usually outside the building) to be conditioned. The outside heat exchanger is usually contained in an enclosure. A fan in the enclosure forces a flow of air through the heat exchanger to promote heat transfer between the air and the refrigerant. The outside enclosure usually has a cover that serves to provide structural strength to the enclosure, prevent debris and direct rain and snow entry as well as perform other functions.

The outside enclosure usually contains the system compressor as well as a heat exchanger. The presence of the compressor and the heat exchanger fan and motor usually results in certain other system components such as controllers, switches, sensors and the like being located on or in the outside enclosure. These components may be located in a box mounted on or near the outside of the enclosure or in the interior of the enclosure with the compressor.

Advances in materials technology and fabrication techniques have led to the use of plastics in a wide variety of new applications. Modern plastics can be strong, durable, damage resistant, lightweight and competitive in manufacturing cost with other materials. Moreover, the ability to easily mold plastic material has enabled the production of components in complex shapes that have previously been difficult and uneconomical to manufacture.

SUMMARY OF THE INVENTION

An object of the present invention is to provide a cover for the outside enclosure of a split air conditioning system.

Another object of the present invention is to provide a cover for the outside enclosure of an air conditioning system that includes an enclosed compartment for installation of electrical and other components of the system.

Another object of the present invention is to provide a means of mounting components of an air conditioning system in the system's outside enclosure in a way that the components will be hidden from normal view, protected from the elements and, at the same time, readily accessible for servicing and maintenance.

Another object of the present invention is to provide an outside enclosure cover that is lightweight, strong, durable, inexpensive to manufacture and aesthetically pleasing in appearance.

These and other objects of the present invention are attained in a novel outside enclosure cover fabricated of a plastic material that contains a recessed compartment having a rainproof closure and provisions for mounting electrical and other components of the system.

By locating components in a compartment in the enclosure cover, the need for and expense of a separate waterproof component box is eliminated, there is no need to mount an unsightly box on or near the exterior of the enclosure nor inside the enclosure where access to the components for servicing and repair may be difficult and time consuming.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
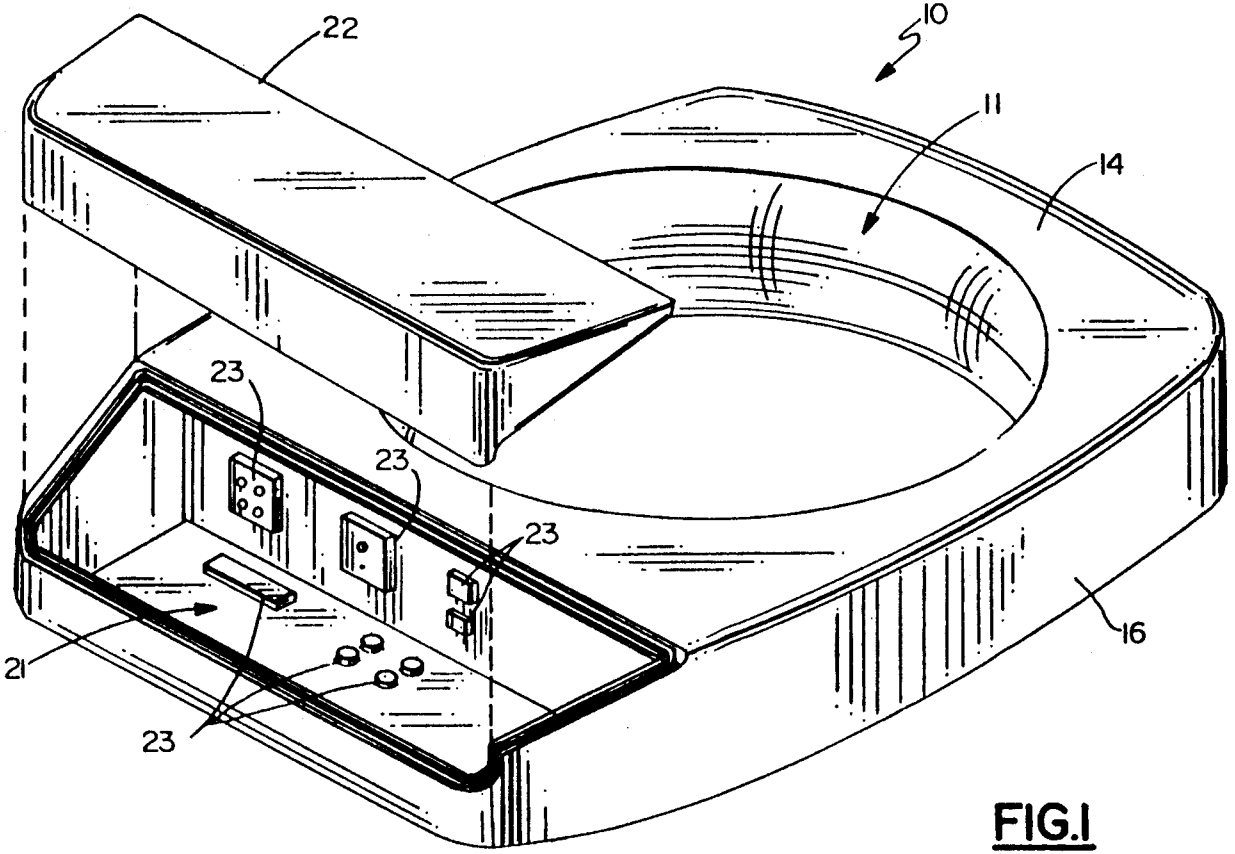
FIG. 1 is an isometric view of the cover of the present invention.

FIG. 1 provides an overall view of one embodiment of the cover of the present invention. In FIG. 1 are shown enclosure cover 10 for the outside enclosure of a split air conditioning or heat pump system. Cover 10 has an upper side 14, a lower side (not shown in this view) and an outer perimeter 16. Extending through cover 10 from the lower side to upper side 14 is air passage 11. In the typical outside enclosure are located a heat exchanger comprising a plurality of tubes through which pass refrigerant and a fan to cause air to flow over and around the tubes to exchange heat with the refrigerant in the tubes. The exterior wall of such an outside enclosure is constructed so that air may pass relatively freely through it. Air passage 11 allows air, urged by the fan, to flow through the cover and through the enclosure. The air flow path may be first through the air passage, then through the fan, then over the heat exchanger and through the enclosure exterior wall, but more usually, the fan discharges through the air passage. Air passage 11 may be of any suitable configuration that provides for good air flow characteristics. The design and configuration of the entire outside enclosure assembly and the air flow path through the enclosure may be such that, in a specific application, there may be no requirement for an air passage in cover 10 at all.

Recessed in cover 10 is compartment 21. Compartment 21 can be of any size and configuration that the configuration of cover 10 will allow and the number and size of the components to be installed require. Disposed on the floor and walls of compartment 21 are component mountings 23. The number, configuration and location of these mountings are as necessary to accommodate the specific components to be mounted in compartment 21. Closure member 22 encloses and makes compartment 21 rainproof. Closure member 22 may be secured to cover 10 by any suitable means such as screws, clips or the like. Closure member 22 may be detachable from or secured by suitable hinges to cover 10.

Figure 2:
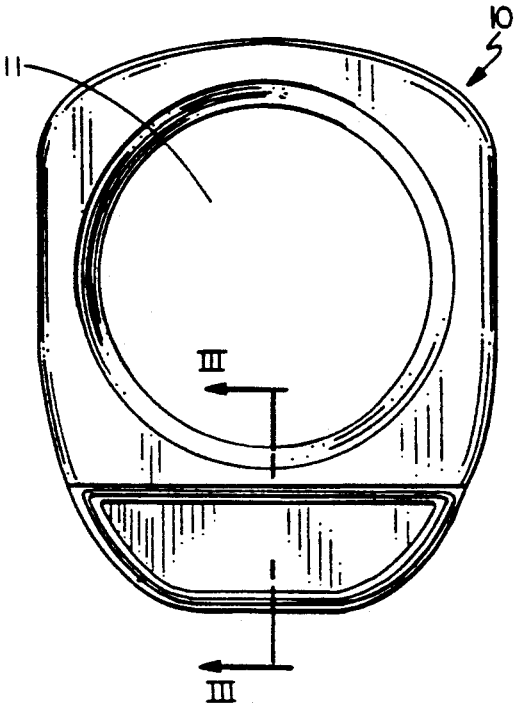
FIG. 2 is a plan view of the cover of the present invention.
Figure 3:
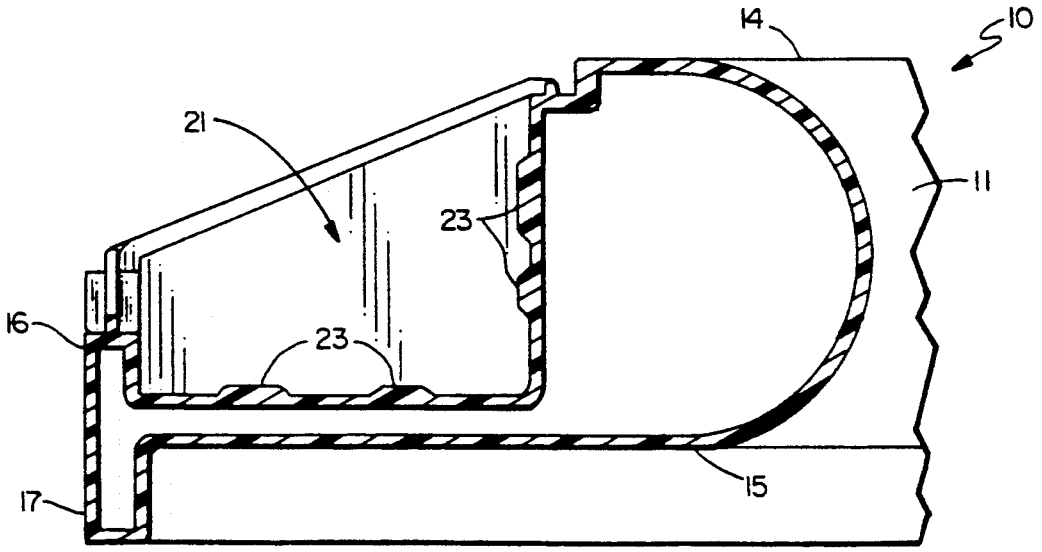
FIG. 3 is an elevation view of a section of the cover of the present invention taken through the line III—III depicted in FIG. 2.

FIG. 2. is a plan view of cover 10. FIG. 3 is an elevation view of a section of cover 10 taken through line III—III in FIG. 2 and gives further details of the configuration of cover 10 and compartment 21. In FIG. 3, it is seen that cover 10 has upper side 14, lower side 15, outer perimeter 16 and skirt 17 extending below lower side 15. Skirt 17 is designed to fit over and outside the upper perimeter of the enclosure with which it will be used in order to provide a means of fixing cover 10 to the enclosure and to provide structural support and thus increase the strength to the entire assembly.

Figure 4:
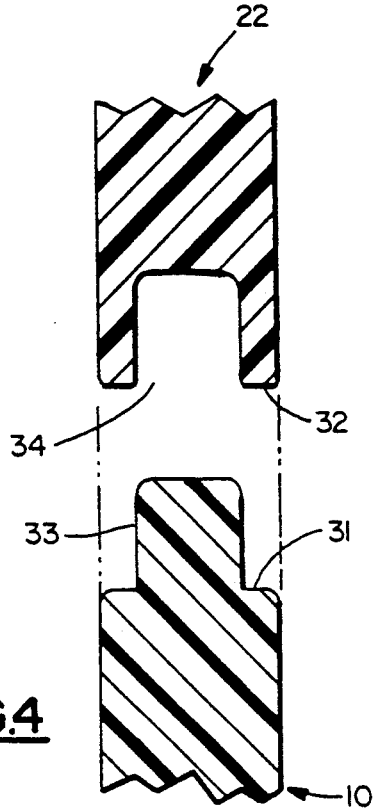
FIG. 4 is a sectioned detail view of the cover and closure member of the present invention showing one means of making the compartment in the cover rainproof.

The joint or joints between cover 10 and closure member 22 can be made rainproof by any suitable means, such as the provision of a gasket at the joint or joints. FIG. 4 depicts a type of joint that may be molded into the cover and closure member joints that will provide a rainproof seal without the use of any additional components. FIG. 4 shows a sectioned detail view of a joint between cover 10 and closure member 22. In the edge 31 of the cover is formed a tongue 33. In the edge 32 of the closure member is formed a groove 34 that will mate with tongue 33 when the closure member is fitted with the cover to close compartment 22.

Figure 5:
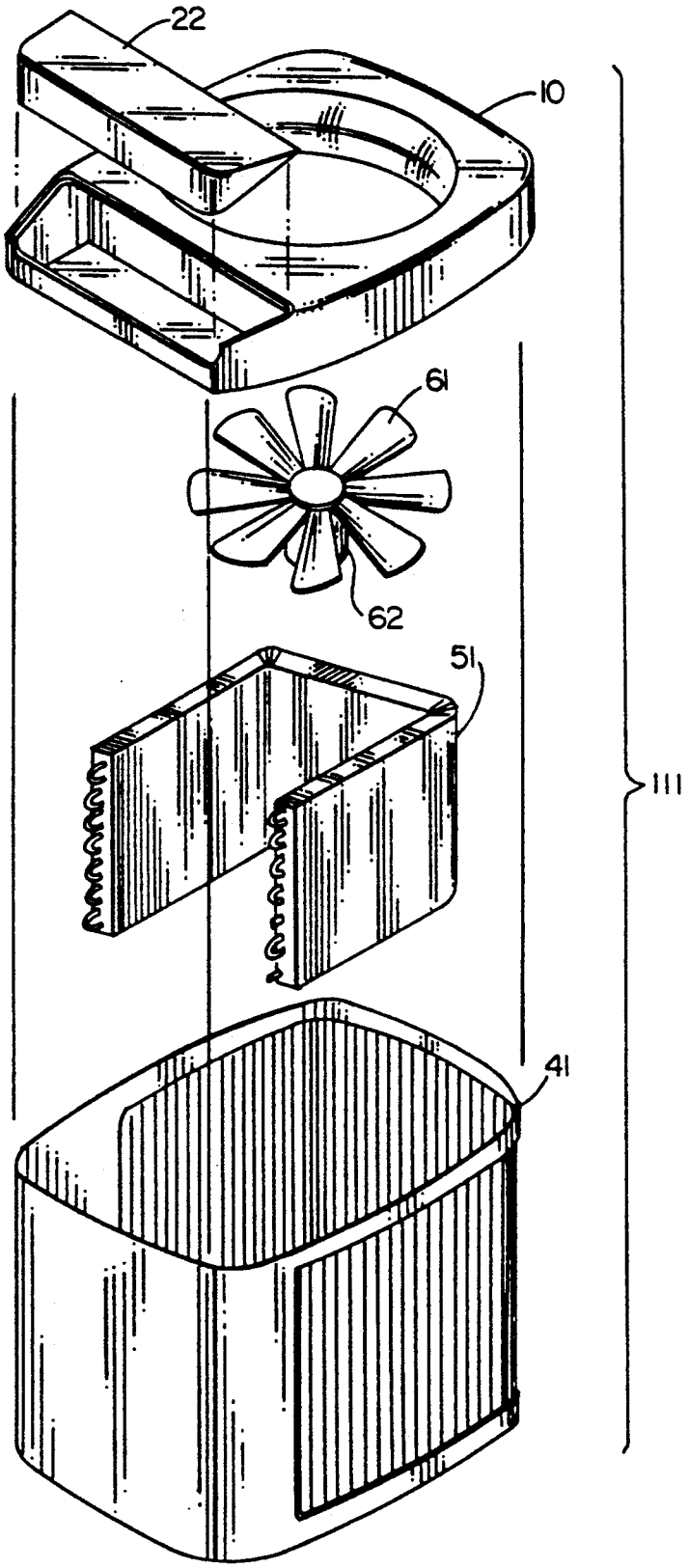
FIG. 5 is exploded isometric view of an outside enclosure of an air conditioning system having the cover of the present invention.

FIG. 5 shows the cover of the present invention in relationship to other components of an outside enclosure. Depicted in that figure is air conditioning system outside enclosure 111. Surrounding outside air-to-refrigerant heat exchanger 51 is enclosure side wall 41. Fan 61 is postioned so as to draw air through the side wall and the outside heat exchanger. Motor 62 driver fan 61.

The compartmented cover can be produced from a number of suitable materials by a variety of manufacturing processes. The cover is particularly well suited, however, to manufacturing from a plastic such as polyethylene using a blow molding process, while the closure member can be fabricated using an injection molding process. It is possible to mold the cover, including the compartment, as a single piece by blow molding. Modern materials and molding processes allow the fabrication of the tongue and the groove joints between the cover and the closure member with the precision required to allow easy fitting up of the closure member to the cover and at the same time provide a rainproof joint without the need for gaskets or other types of additional sealing.

While the above describes particular embodiments of the present invention, other embodiments that are within the scope of the invention may occur to one skilled in the art. The above description should be construed as illustrative and the scope of the invention limited only by the scope of the below claims.

We claim:

1. An outside enclosure (111) for an air conditioning system comprising:

a side wall (41);

an air-to-refrigerant heat exchanger (51) positioned within said wall;

a fan (61) positioned so as to cause a flow of air through said heat exchanger and said wall; and a top cover (10) positioned above said wall, said cover comprising a main body having an outer perimeter (16), compartment means (21) recessed into said main body, means (23) for mounting electrical and other components of said air conditioning system in said compartment means, a compartment closure member (22) adapted to making said compartment means weatherproof and means (17) around said outer perimeter for attaching said cover to said wall.

2. The enclosure of claim 1 in which said main body, including said compartment means, of said cover is fabricated by molding into a single piece structure.

* * * * *